US009220943B2

(12) United States Patent
Walker et al.

(10) Patent No.: US 9,220,943 B2
(45) Date of Patent: Dec. 29, 2015

(54) ALTERNATIVELY SLIDABLE AND STATIONARY PLATFORM

(71) Applicant: Andrew Hal Walker, Los Angeles, CA (US)

(72) Inventors: Andrew Hal Walker, Los Angeles, CA (US); Yan-Ziun Tzeng, Monterey Park, CA (US); George Ignatius Tamara, Huntington Beach, CA (US)

(73) Assignee: Andrew Hal Walker, Los Angeles, CA (US)

( * ) Notice: Subject to any disclaimer, the term of this patent is extended or adjusted under 35 U.S.C. 154(b) by 105 days.

(21) Appl. No.: 14/060,531

(22) Filed: Oct. 22, 2013

(65) Prior Publication Data

US 2015/0111705 A1 Apr. 23, 2015

(51) Int. Cl.
*A63B 26/00* (2006.01)

(52) U.S. Cl.
CPC ..... *A63B 26/00* (2013.01)

(58) Field of Classification Search
CPC .... A63B 21/0004; A63B 21/00069–21/00072; A63B 21/012–21/015; A63B 21/068; A63B 21/1457–21/1461; A63B 21/1484; A63B 21/1496; A63B 21/22–2021/222; A63B 22/0087–22/0089; A63B 22/14–2022/185; A63B 22/20–22/203; A63B 23/02–23/0227; A63B 26/003–2026/006
See application file for complete search history.

(56) References Cited

U.S. PATENT DOCUMENTS

| | | | | |
|---|---|---|---|---|
| D428,454 | S | 7/2000 | Fischer et al. | |
| D446,264 | S | 8/2001 | Fischer et al. | |
| 7,981,016 | B1 | 7/2011 | Howard | |
| 8,016,732 | B2 | 9/2011 | Susnjara | |
| 8,382,645 | B2 * | 2/2013 | Mylrea et al. | 482/51 |
| 2005/0209073 | A1 * | 9/2005 | Chen | 482/146 |
| 2006/0105895 | A1 * | 5/2006 | Lu | 482/146 |
| 2007/0184951 | A1 * | 8/2007 | James et al. | 482/141 |
| 2008/0064578 | A1 * | 3/2008 | Huang | 482/146 |
| 2009/0275451 | A1 * | 11/2009 | Chiang et al. | 482/146 |
| 2011/0118088 | A1 * | 5/2011 | Caya et al. | 482/51 |

OTHER PUBLICATIONS

Power Wheel as shown in http://www.lifelineusa.com/products/power-wheel.html dated Wednesday, Sep. 4, 2013.
UltraSlide Slide Boards as shown in http://www.ultraslide.com/slideboards-pages-156.php dated Wednesday, Sep. 4, 2013.

* cited by examiner

*Primary Examiner* — Oren Ginsberg
*Assistant Examiner* — Jennifer M Deichl
(74) *Attorney, Agent, or Firm* — Foley & Lardner LLP

(57) ABSTRACT

A portable platform is disclosed that may be switched from a sliding mode to a stationary mode and back again by retracting or extending pads from the underside of the device. The embodiments may be used for a variety of purposes, including moving heavy objects, and performing fitness routines.

20 Claims, 12 Drawing Sheets

FIG. 2A
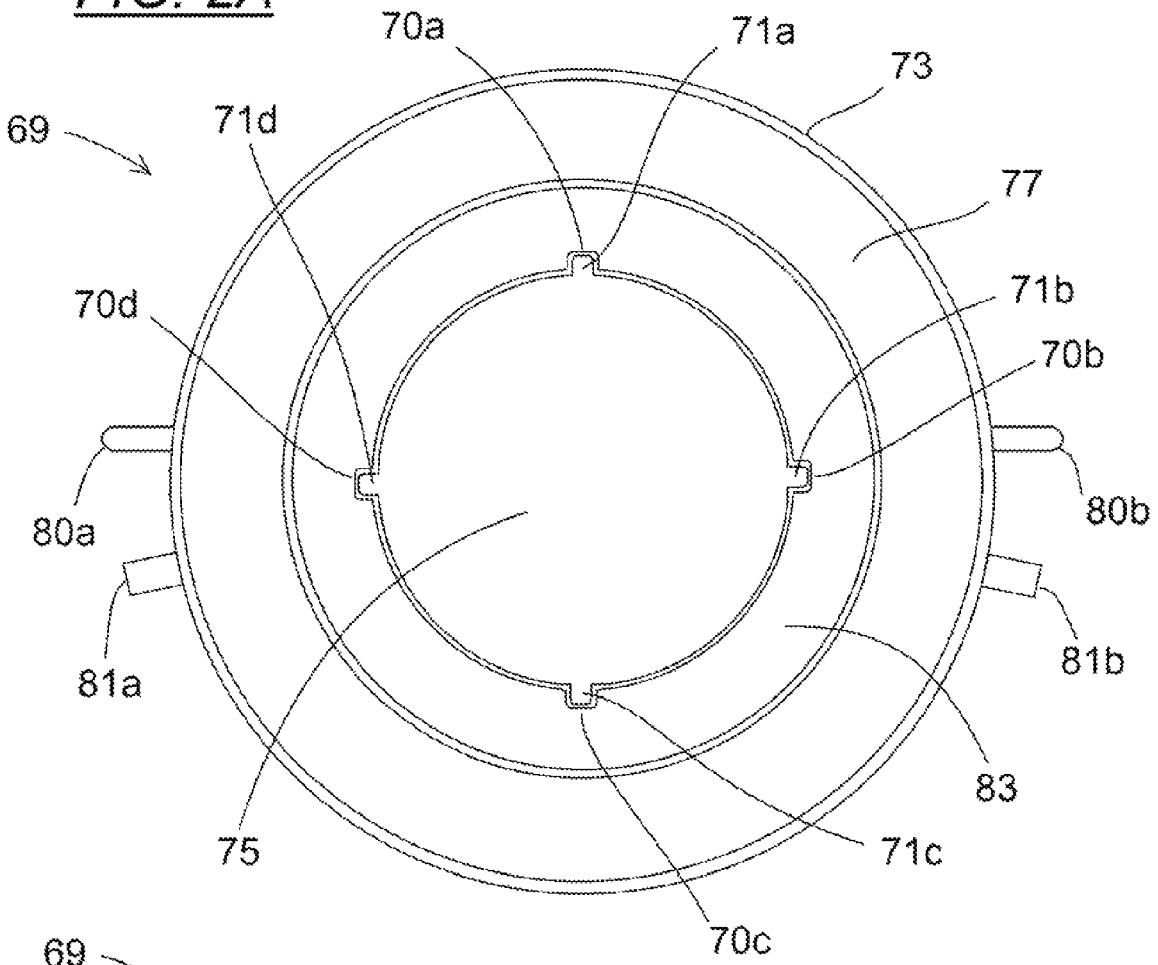
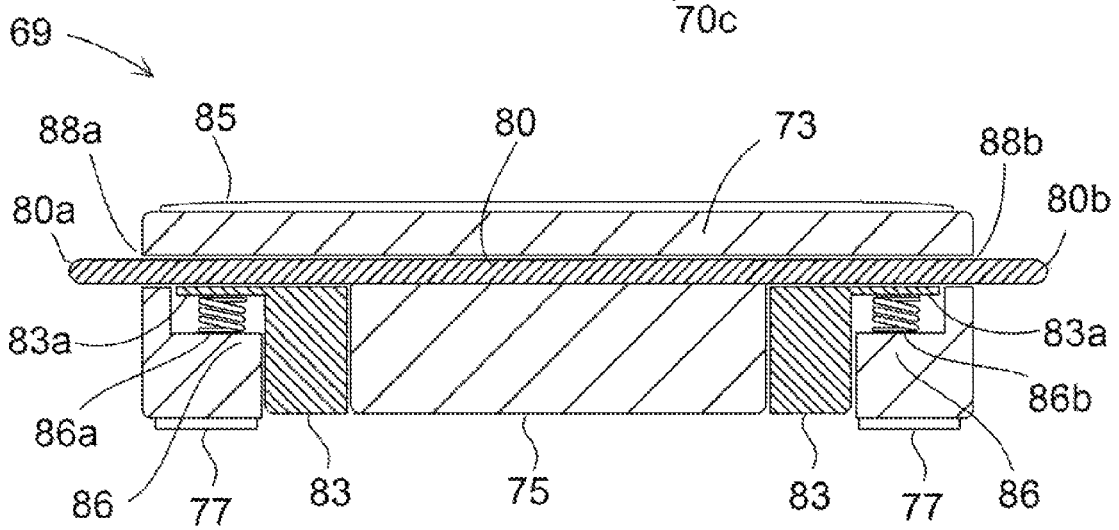
FIG. 2B

FIG. 4A
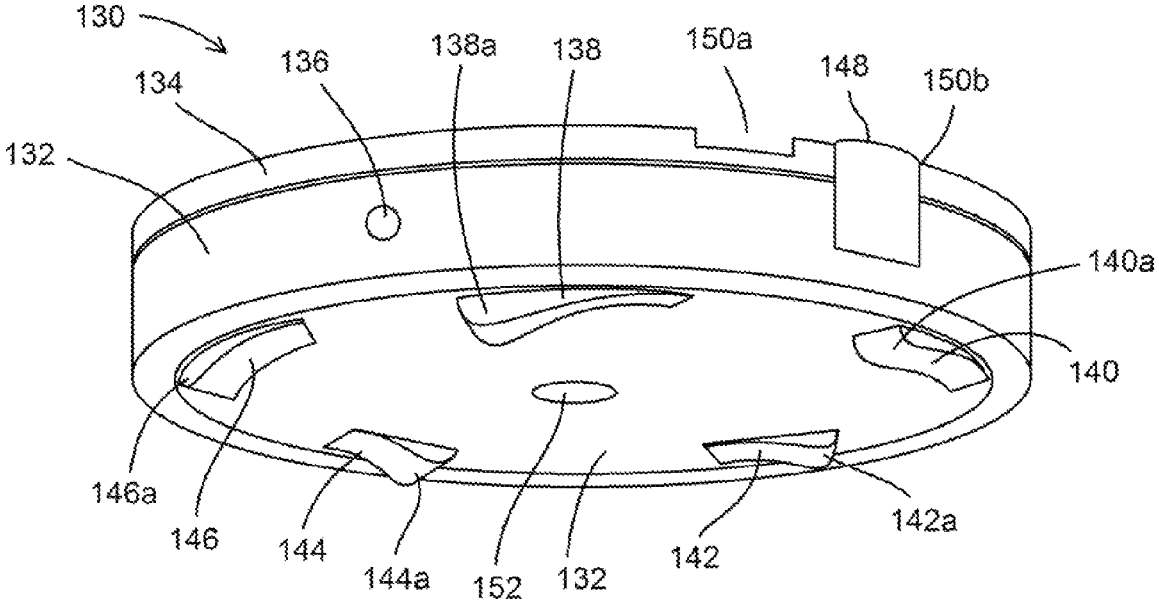
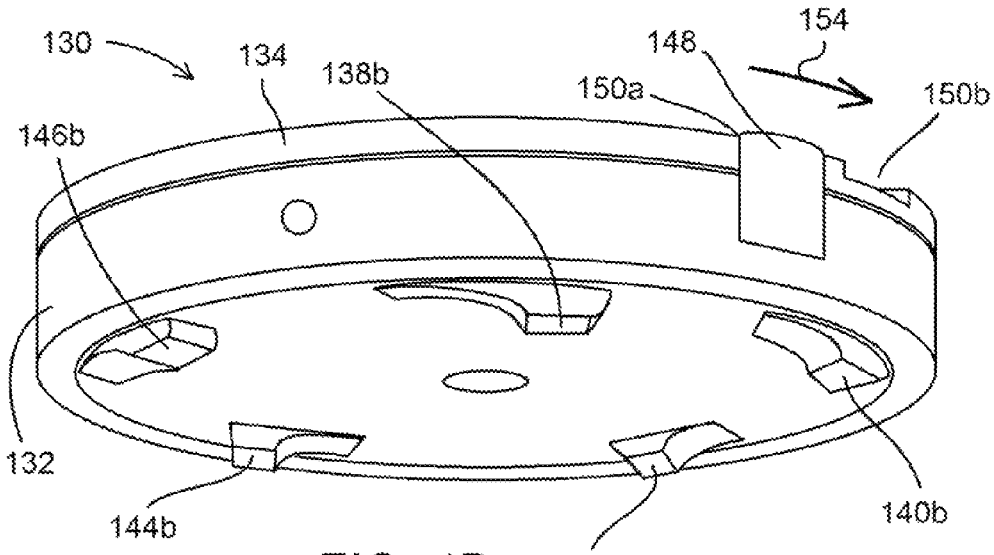
FIG. 4B

FIG. 5A
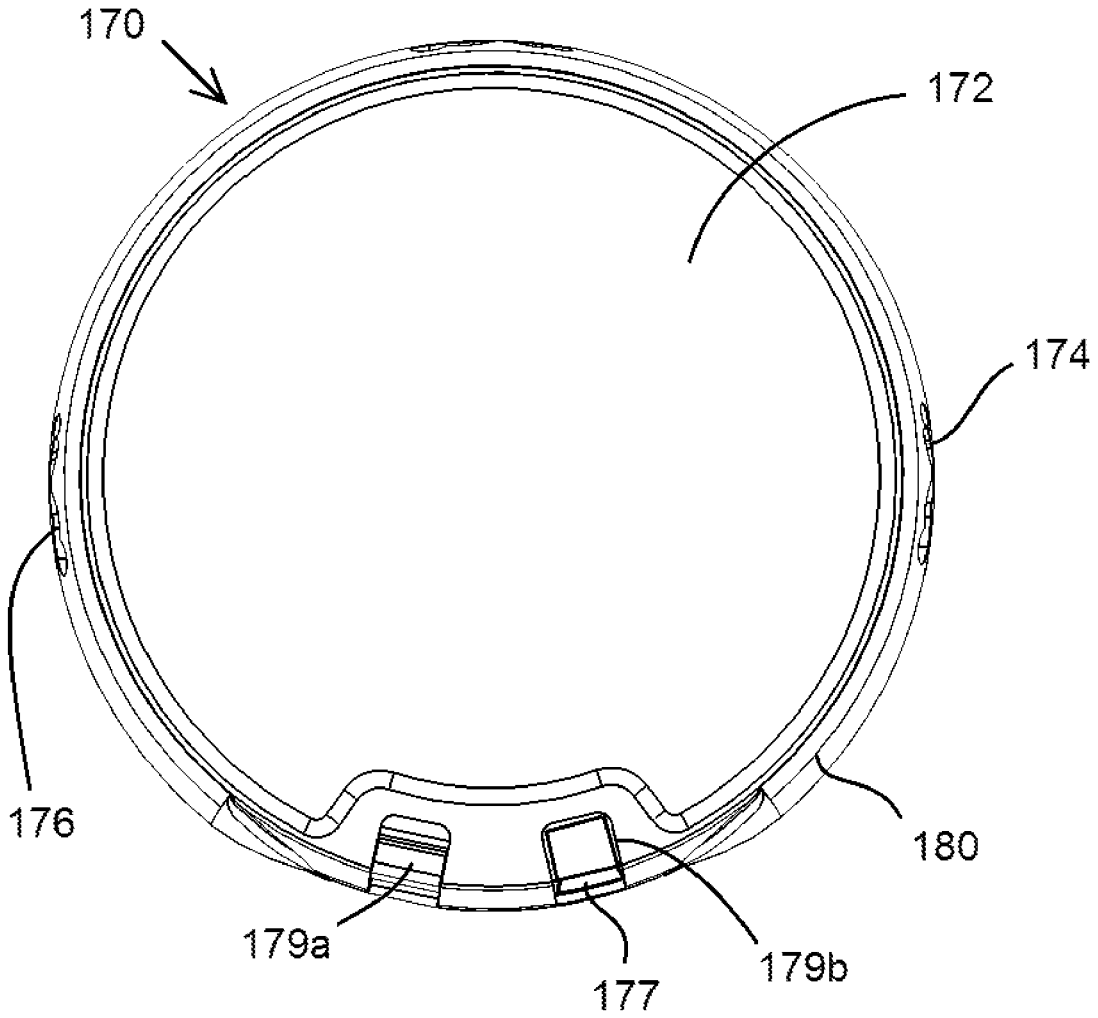
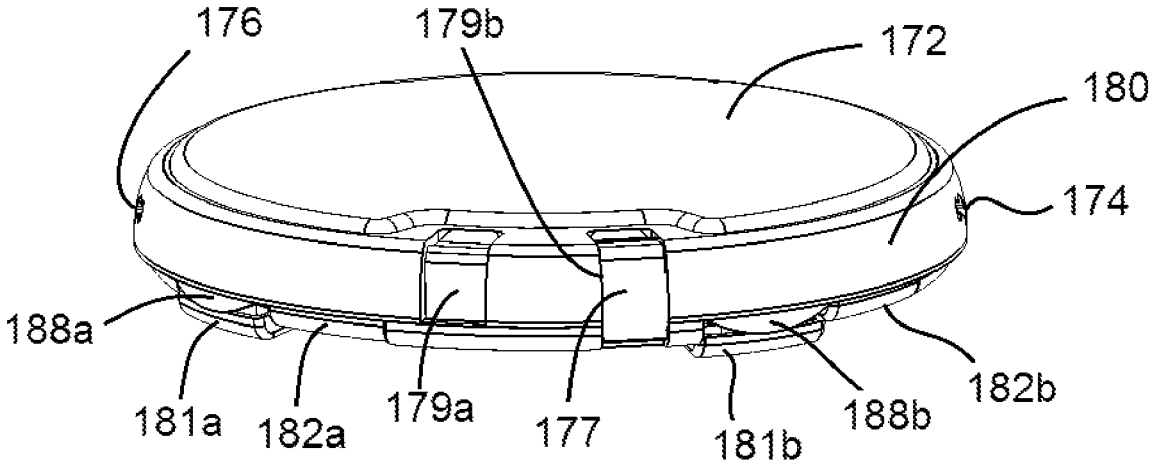
FIG. 5B

ALTERNATIVELY SLIDABLE AND STATIONARY PLATFORM

FIELD OF THE INVENTION

The present disclosure relates to portable sliding platforms or dollys that may be placed under an object to allow the object to slide across the ground. In various embodiments, the disclosed platforms may be used to perform fitness exercises.

BACKGROUND

Portable sliding platforms such as dollys may be used to perform a variety of activities such as moving heavy furniture and storage boxes. Portable sliding platforms traditionally consist of a broad surface supported by evenly spaced rolling casters or ball transfer units. Small Teflon-coated discs may also be placed under the legs of heavy furniture to allow the furniture to slide across the floor. The portability of the platform allows an individual to readily move it from place to place, and from a storage location to the location where it will be used. Portable sliding platforms—as well as portable stationary platforms—have also been used as exercise equipment.

Portable Sliding Exercise Platforms

In their simplest form, portable sliding exercise platforms include dollys with a surface area wide enough to accommodate at least one hand or foot, if not two. Traditionally, these devices have omnidirectional caster wheels or ball transfer units, although some now utilize felt or Teflon-like materials to allow slippage across hardwood or carpeted floors.

The exercises that may be performed with sliding platforms are numerous. For example, by placing one's knees on the floor and one's hands on the sliding platform, one is able to first slide outward so that one's belly comes near to the floor, and then contract one's abdominal muscles to pull one's body back towards one's knees. This motion is highly effective for exercising the abdominal muscles.

One could also fix a first foot on the ground and second foot on the platform, and by sliding the platform in controlled motions, exercise one's legs. One might also attach elastic chords between the platform and a fixed post, sit on the platform, and then push one's legs against a fixed surface to exercise one's leg muscles. Alternatively, using two platforms and placing a palm on either one while doing push-ups forces the user to utilize muscles to control their motion and maintain balance. These are just a limited sampling of the varieties of exercises that may be performed with sliding platforms.

Portable Stationary Exercise Platforms

Stationary portable exercise platforms are also used to perform a wide variety of exercises. One way they may be used is as a stepping platform to alternatively step up and step down from. Another way they may be used is to elevate one's hands or feet off the floor, while the unsupported hands or feet rest at ground level. If one performs push-ups in this manner, for example, the extra elevation provided by the stationary platform will allow for a different range of motion and target different muscle groups. These are just some of the many exercises that may be performed using a portable stationary exercise platform.

Portable Exercise Platforms that can Alternately Slide and Remain Stationary While portable sliding and stationary platforms are ubiquitous, it is less common to find a portable platform that can alternate between a sliding and stationary mode. An example of a slidable locking platform is a dolly mounted on casters with wheel lock levers.

In the field of portable platforms used for fitness exercises, it is very rare to find a platform that is capable of alternating between a sliding and stationary mode. One example that mimics the wheel lock dolly just described was recently disclosed in U.S. Pat. No. 7,981,016 issued to Howard. Howard discloses a slidable exercise platform mounted on ball transfer units that he suggests may be locked to prevent rotation. It is believed, however, that simply locking the wheels of sliding platform would not provide the stability that users would demand of a stationary exercise platform. The surface area of wheels or ball transfer units that contacts the floor is minimal, and even if the wheels or ball transfer units were locked, it is unlikely that enough friction would be generated with the ground to keep the platform stationary during vigorous exercise.

It has also been proposed in U.S. Pat. No. 8,016,732 issued to Susnjara to have two platform units that can be attached to one another. Susnjara discloses a slidable exercise platform mounted to wheel casters, along with a separate attachable base portion with rubber grips for engaging the floor. According to Susnjara, when the user wishes to switch from slidable to stationary mode, the user can affix the rubber-coated base portion to bottom of the slidable platform so that it covers the wheels and forms a high-friction engagement with the ground.

It is believed, however, that devices of the kind proposed by Susnjara do not provide a practical solution to the problem of switching between sliding and stationary modes. Exercise enthusiasts who use slidable boards want to be able to switch quickly and easily from sliding to stationary modes without having to interrupt their exercise routines. Indeed, entirely new forms of exercise are made possible by providing a portable exercise platform capable of switching from sliding to stationary modes "on the fly" as the user is in the middle of performing an exercise.

SUMMARY OF THE INVENTION

Disclosed herein are portable platforms having at least two different bottom surfaces for engaging the ground, the first of which surface may be either retracted toward or into the main body of the platform to expose the second surface to the ground, or extended such that the first surface contacts the ground instead of the second surface. One of the surfaces just described has a coating of a relatively high-friction material (such as a rubberized material) suitable for keeping the platform in a stationary position. The second surface includes either ball transfer units, or a coating of a suitably low-friction material such as felt, Teflon or other smooth polymer that allows the platform to slide across the ground under heavy loading. It is also possible to have more than two retractable/extendable surfaces made of materials having different friction properties so that the degree of friction with the ground may be selected with more precision.

In more particular embodiments, the first and second bottom surfaces may consist of pads or feet that may be extended or retracted by twisting the platform to cause an internal structure to push one or the other of the surfaces outward toward the floor. Alternatively, a spring-loaded mechanism may be used to keep one or more pads retracted, and then a locking lever used to extend those pads.

As will be understood from the detailed description of embodiments herein, the design of the device enables rapid "on the fly" switching between sliding and stationary modes, which is particularly useful when the device is used to perform fitness routines.

Although reference may be made herein to the inventive platforms supporting the weight of an "object" or "objects," it should be understood that this reference is intended to include supporting the weight of not only inanimate objects, but also persons placing some or all of their weight on the platform, or anything else having mass that is desired to be moved across a floor.

IN THE DRAWINGS

FIG. 2A is a bottom view of another embodiment of the present invention.

FIG. 2B is a side cross-sectional view of the embodiment shown in FIG. 2A.

FIG. 4A is a perspective view of the side and underside of another embodiment of the present invention.

FIG. 4B is a perspective view of the side and underside of another embodiment of the present invention.

FIG. 5A is a top view of another embodiment of the present invention.

FIG. 5B is a perspective view of the top and side of the embodiment shown in FIG. 5A.

DETAILED DESCRIPTION

It is an object of the present invention to provide a portable sliding platform that is capable of allowing heavy objects to be slid across a surface, while also being able to easily assume a stationary position.

It is a further object of the present invention to provide a portable exercise platform for use in fitness routines that is capable of quickly and easily switching from sliding to stationary modes, wherein the device is capable of gliding across a floor smoothly in sliding mode, and is capable of maintaining its position during vigorous exercise while in stationary mode.

It is a further object of the present invention to provide a sliding platform of the kind just described that is relatively easy to manufacture and has a minimum of moving parts.

It is a further object of the present invention to provide a portable platform having all the above-described advantages while being a single, self-contained unit without the need for adding or removing parts to achieve its function.

Concentric Pad Embodiments: Screw Mechanism Example

FIGS. 1A-1F illustrate a circular, portable slidable platform 20 that, depending on its size, could be suitable as a dolly for moving heavy loads across a floor, or as a piece of exercise equipment. It should be understood that the term "portable" refers to a wide range of platforms that may be carried by a person from one place to another, including relatively small platforms only inches in size, moderately-sized platforms used for exercise purposes or for moving medium-size objects, or larger-size platforms that may be several feet wide yet still capable of being carried by a person.

Figure 1A:
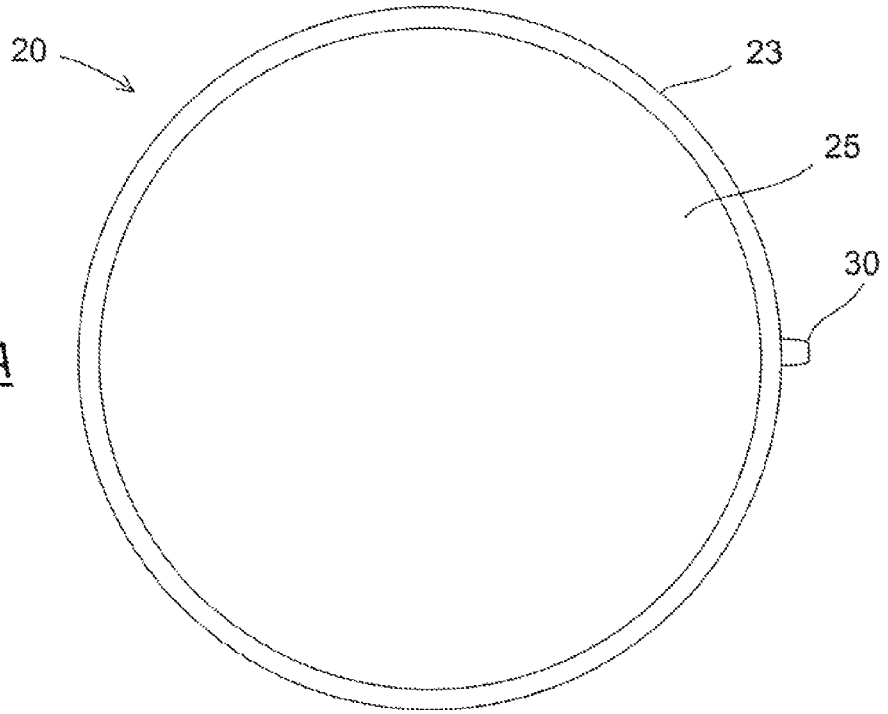
FIG. 1A is a top view of an embodiment of the present invention.

FIG. 1A is a top view of platform 20. The main body 23 of the platform 20 is a flat-surfaced, cylindrical disc. Although the main body 23 is shown here in cylindrical disc form, it should be understood that the platform could be any number of different shapes or dimensions while still utilizing the inventive features disclosed herein. For example, if used to carry an object of a particular shape, the main body 23 might have a corresponding shape to help support the object and prevent it from sliding relative to the platform. The outer form of main body 23 might also be designed to have a rectangular or oblong shape.

Depending on the use that the platform is put to, it could be constructed of a variety of different materials. When used for moving heavy objects, it may be preferable to construct the main body 23 from steel, whereas when the device is used for exercise, it is advantageous that the device be made of a lighter material such as a reinforced polymer or plastic.

The top surface of platform 20 is covered by a padded material 25 that may be made of foam or similar suitable soft substance. Depending on the use that the device is put to, it may be advantageous for the surface of the padding 25 to have a relatively high friction coating so that objects or persons resting on its surface do not tend to slide off. Of course, padding may be unnecessary for certain uses of the device.

A knob 30 is shown protruding from the side of the main body 23. The function of the knob—which will be explained in more detail below—is to facilitate convenient switching between the sliding and stationary modes of the platform.

Not shown in FIG. 1A are optional handles that may be attached to the top or sides of main body 23. Handles on platforms are commonly known in the art and serve as gripping points, particularly for certain exercise routines. Handles may also serve as bracing holds to steady the platform when switching from stationary to sliding modes or vice versa.

Figure 1B:
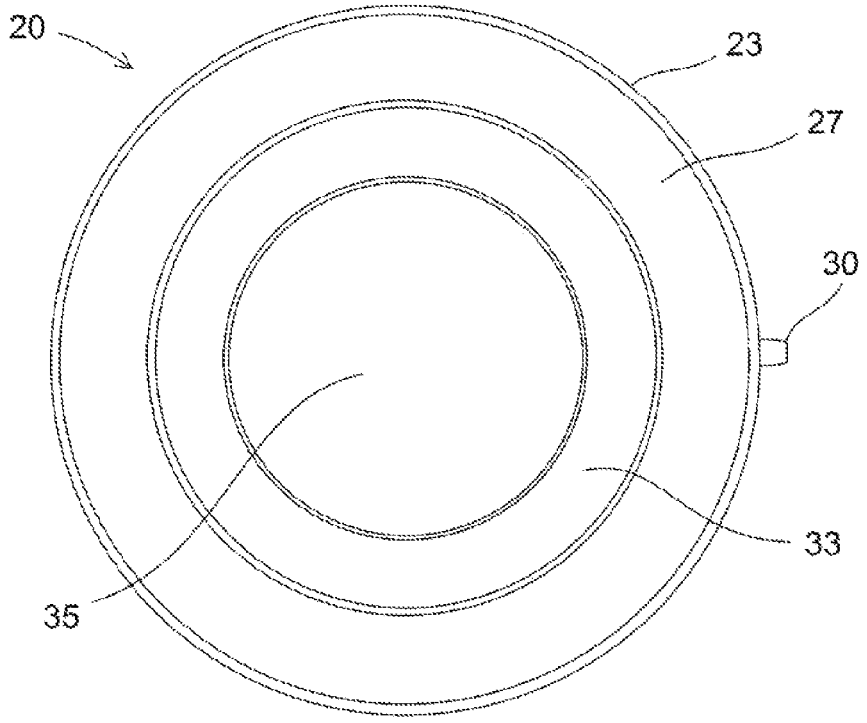
FIG. 1B is a bottom view of the embodiment shown in FIG. 1A.

Referring now to FIG. 1B, a bottom view of platform 20 is shown. This is the portion of the device that is to be placed adjacent to the floor. The central column 35 is actually part of the main body 23. As will be appreciated from further discussion herein, column 35 does not contact the ground. Rather, column 35 serves as a support structure for first ringed floor pad 33.

Inner ringed floor pad 33 is rotatably mounted via a screw thread to central column 35 such that inner pad 33 may be screwed upward into the main body 23 or screwed outward so that it comes into contact with the ground. Concentrically encircling inner pad 33 is outer pad 27, which is rigidly mounted directly to the underside of main body 23. When inner pad 33 is retracted within main body 23, outer pad 27 contacts the ground and supports the platform 20. When inner pad 33 is extended from the main body 23, inner pad 33 contacts the ground to support platform 20, while outer pad 27 is elevated above the ground and does not contact the ground.

Figure 1C:
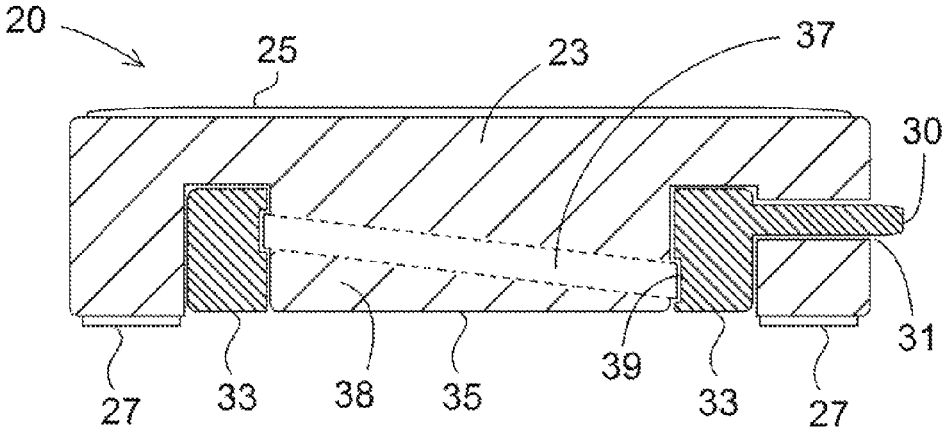
FIG. 1C is a side cross-sectional view of the embodiment shown in FIG. 1A.

The foregoing functionality can be better understood with reference to FIGS. 1C-1F. Referring first to FIG. 1C, we see a side view cross-section of the same platform 20 shown in FIGS. 1A-1B. The cross-section reveals the overall shape of the main body 23, which includes central column 35. The main body 23 and central column 35 are shown here as solid, but it should be understood that these parts can be cast as hollow if made of suitably strong material for the purpose the platform will be put to.

Encircling the central column 37 is a relatively large screw thread 37, elevated off the surface of central column 35. The purpose of screw thread 37 is to engage the corresponding track 39 on the inner wall of first ring pad 33, and thus enable inner pad 33 to be screwed either upwards into the main body 23, or downwards towards the ground.

Inner pad 33 may be screwed up or down relative to central column 35 by means of knob 30, which is connected to the side of inner pad 33 and projects externally from main body 23 through track opening 31 in the side of main body 23. In FIG. 1C, inner pad 33 is shown screwed up entirely within main body 23 such that only outer pad 27 contacts the ground.

Figure 1D:
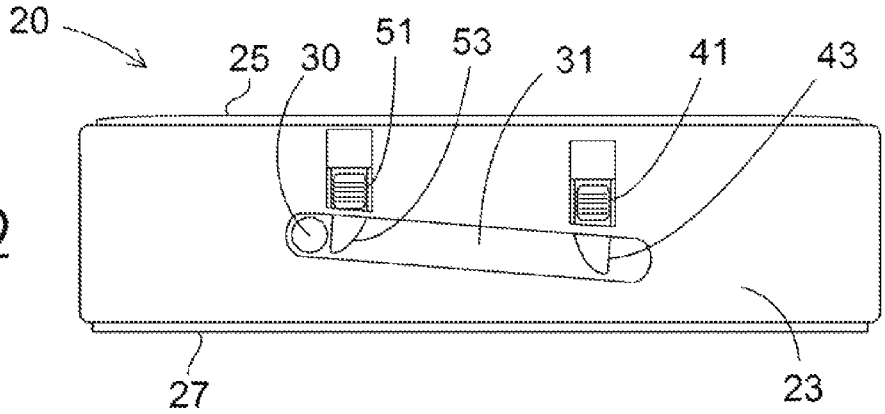
FIG. 1D is a side view of the embodiment shown in FIG. 1A, rotated 90 degrees relative to FIG. 1C.

Referring now to FIG. 1D, we see an external rotated view of the same platform shown in FIG. 1C. Here, the platform is rotated so that we are viewing knob 30 head-on as opposed to from the side, as in FIG. 1C. As can be seen in FIG. 1D, knob 30 rests in the upper portion of slanted track opening 31 when inner pad 33 is retracted within main body 23, exposing outer pad 27 to the ground.

Knob 30 is retained in the upward position shown in FIG. 1D by virtue of snap lock 53. The side of snap lock 53 facing knob 30 is flat, and prevents knob 30 from sliding downward in track 31. Conversely, the side of snap lock 53 facing the rest of track 31 has a curved surface. Snap lock 53 is spring loaded, such that if knob 30 were to the right snap lock 53 and pushed toward its curved side, snap lock 53 would rise upward and allow knob 30 to slide into locked position to its left. Once knob 30 passes snap lock 53, a spring mechanism forces snap lock 53 downward, locking knob 30 in place (and thereby retaining inner pad 33 in a retracted position with main body 23).

Snap lock 53 is has a grip 51 just above it on the side of main body 23. If it is desired to extend inner pad 33, snap lock 53 may be released by pushing upward on grip 51 against the spring force, thereby sliding snap lock 53 upward and allowing knob 30 to pass. A corresponding snap lock 43 and grip 41 are at the opposite end of track 31, and function in the same manner as snap lock 53 and grip 51.

Figure 1E:
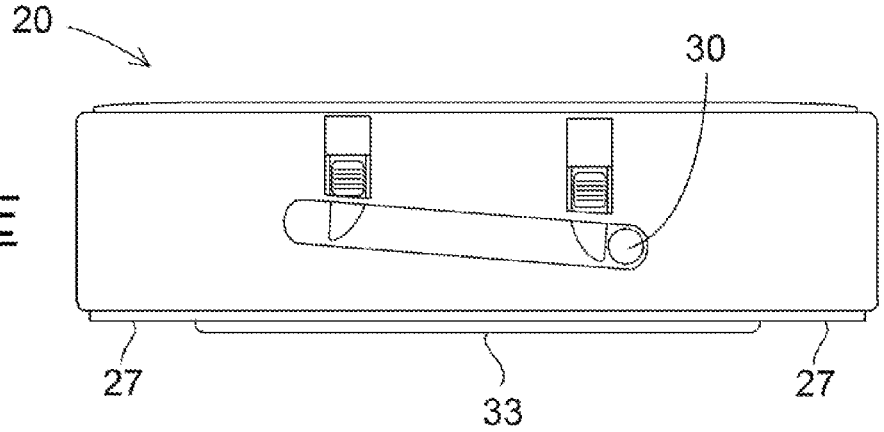
FIG. 1E is a side view of the embodiment shown in FIG. 1A, in the same position as FIG. 1D.

Pushing knob 30 down and to the right will accomplish twisting inner pad 33 about central column 35, thereby extending inner pad 33 outwards towards the ground and past outer pad 27, as shown in FIG. 1E. By locking knob 30 to the right of snap lock 43, inner pad 33 may be retained in an extended position.

Of course, it is not necessary that snap locks 53 and 43 be spring loaded. A user might just as easily raise and lower the locks by pressing up or down on grips 51 and 41. The spring-loaded feature merely saves the additional step of having to press down on the grips.

It may be advantageous to design knob 30 out of a resilient material that would naturally not be able to extend to the far ends of track 31 unless a certain degree of force is applied. That way, once the user forces knob 30 into a locked position behind either of snap locks 53 or 43, knob 30 will tend to press tightly against the snap locks and not be inclined to allow inner pad 33 to wriggle.

Figure 1F:
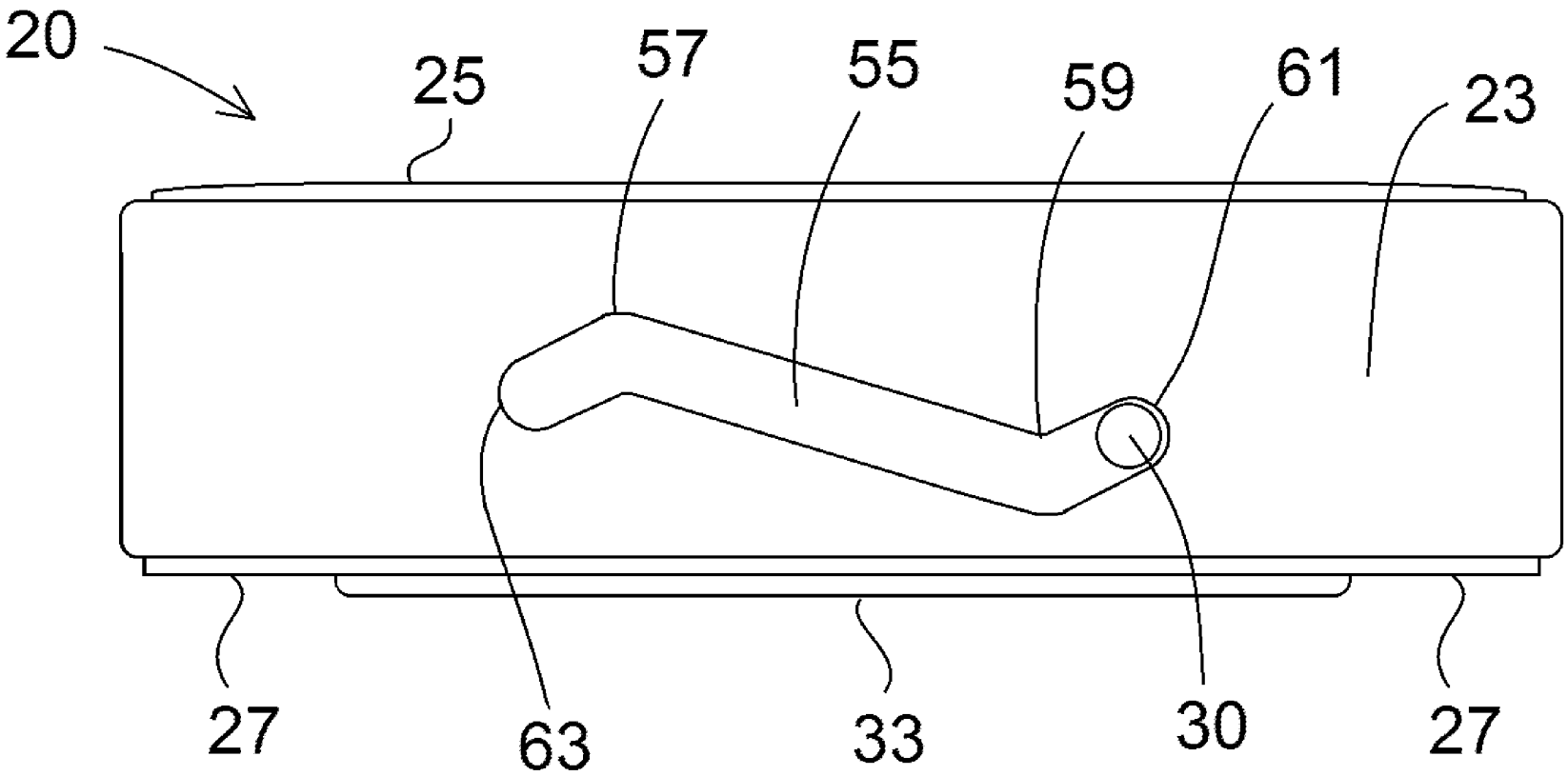
FIG. 1F is a side view of an embodiment of the invention similar to that shown in FIG. 1A.

FIG. 1F shows an alternative means of locking knob 30 in place without the use of snap locks. In this embodiment, straight track 31 has been replaced by curved track 55, having two bends 57 and 59. FIG. 1F depicts platform 20 with inner pad 33 extended by virtue of knob 30 being twisted far to the right in track 55.

Although knob 30 is attached to inner pad 33 which is compelled to rotate about a path dictated by central column screw thread 37, knob 30 has some degree of flexure across its length, allowing it to be bent somewhat to follow the uneven path of track 55. At the same time, knob 30 is stiff enough that it will seek to return to a straight position after being bent. To achieve these ends, it is desirable that knob 30 be made of a stiff metal or plastic material of sufficient diameter that it will be able to be bent sufficiently to move past bends 57 and 59, while having sufficient stiffness to return to ends 63 and 61 after being released.

When knob 30 is brought to the far right end 61 of track 55, pressure from an object or objects on top of platform 20 will cause the ground to press upwards against inner pad 33, which will in turn cause knob 30 to be pressed upward into end 61 of track 55. Bend 59 in track 55 will tend to hold knob 33 in that position. Note that internal central column screw threading 37 will also serve to restrain inner pad 33 from being forced upward into main body 23.

Conversely, if the user brings knob 30 to the far left of track 55, this will cause inner pad 33 to retract, exposing outer pad 27 to the ground. In this retracted position, inner pad 33 will be drawn towards the ground by gravity, which will in turn tend to cause knob 30 to press downward against end 63 of track 55. Here, bend 57 in track 55 will tend to keep knob 30 in position at end 63 until knob 30 is moved from that position by the platform's user. Note again that central column screw threading 37 will also help restrain inner pad 33 from vertical movement, taking part of the load off of knob 30.

The shape of track 55 and the angle of bends 57 and 59 may be modified to suit different purposes. For example. If it is desired that the knob 30 be held more tightly at track ends 63 or 61, bends 57 and 59 can be designed to have a more exaggerated arch. The angle of the arch will ultimately be limited by the stiffness and degree of flexure allowed by knob 30. As discussed above, varying the composition or diameter of knob 30 will vary its stiffness and flexibility.

It is also possible that bends 57 and 59 can take on more complex shapes—such as loops or curls—that tend to trap knob 30 at ends 63 and 61. While making the shape of bends 59 and 57 more complex may tend to make it more difficult to secure knob 30 at one end or another, the added security may be desirable when platform 20 is put to more vigorous use. As before, the degree to which the curvature of bends 57 and 59 may be exaggerated is governed by the flexibility of knob 30.

It should be understood that in all the foregoing embodiments, it is necessary to design main body 23 in such a manner that there is sufficient space internally for knob 30 to travel whatever path is dictated by tracks 31 or 55.

It is also possible to design platform 20 with a second knob like knob 30 on the opposite side of the platform. This knob would also be connected to inner pad 33 and would function in the same way as knob 30. The advantage of using two knobs is that it would allow greater force to be applied via two-handed operation of the device.

Concentric Pad Embodiment: Spring Mechanism Example

Figure 2C:
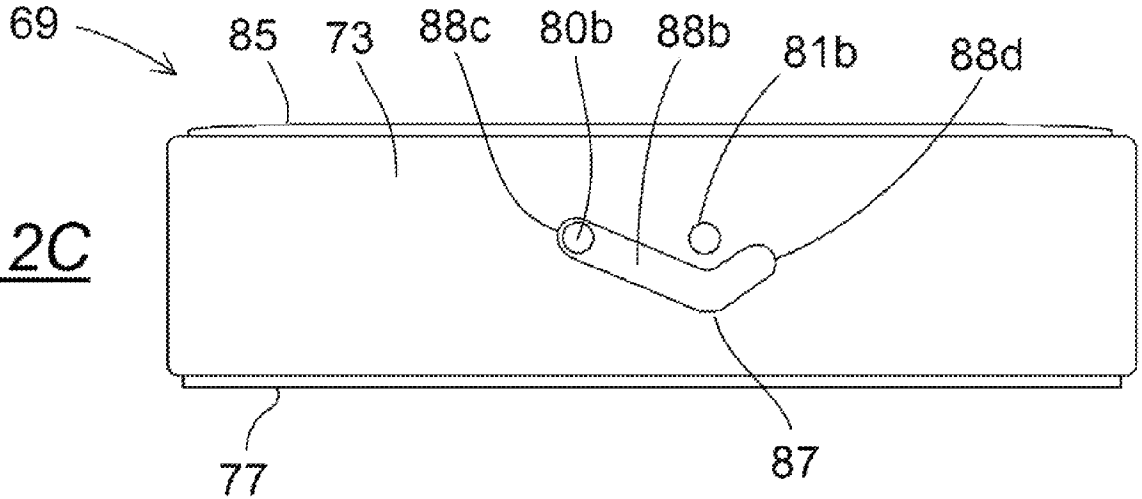
FIG. 2C is a side view of the embodiment shown in FIG. 2A, rotated 90 degrees relative to FIG. 2B.

Turning now to FIGS. 2A-2D, we see an alternative way to achieve the objects of the invention using concentric pads mounted about a central column 75. Referring to FIG. 2A, we see a bottom view of the underside of portable platform 69 that would be placed adjacent to the ground. Platform 69 has a main body 73 with a central column 75. Column 75 is not designed to touch the ground, but rather serves to mount inner pad 83 and outer pad 77 that encircle it. These are analogous to pads 33 and 27 of FIGS. 1A-1F.

Here, instead of the inner pad being rotatably screwed around the central column with a screw thread, inner pad 83 is not permitted to rotate about central column 75. Instead, inner pad 83 has straight vertical grooves 70*a*, 70*b*, 70*c* and 70*d* about its inner wall that engage corresponding straight vertical ridges 71*a*, 71*b*, 71*c* and 71*d* on central column 75. This mounting system allows inner pad 83 to slide vertically relative to column 75, but restrains rotation about the central column. Outer pad 77 is fixed to the bottom of main body 73 and does not move relative to other parts of the device.

A single rod 80 passes through the main body 23 from one side to the other and has protruding handles 80*a* and 80*b*. Grips 81*a* and 81*b* are fixed to the exterior of main body 73 and their function will be explained further below.

Referring to FIG. 2B, we see a cross-sectional view of platform 69. Rod 80 passes through main body 73 from one side to the other. As will be understood from FIGS. 2C-2D, rod 80 only occupies a zone in the middle of main body 73 such that column 75 may be joined to top portion of main body 73 in the zones not occupied by rod 80. Rod 80 has handles 80*a* and 80*b* that protrude from main body 73 through track openings 88*a* and 88*b* in the sides of main body 73.

FIG. 2B shows inner pad 83 in a vertically raised upward position resting under rod 80. The function of rod 80, as will be explained further below, is to push down on the top of inner pad 83 to cause it to protrude from the bottom of main body 73 past outer pad 77. In the position shown in FIG. 2B, outer pad 77 engages the ground rather than inner pad 83.

The top of inner pad 83 has a broad rim 83*a* in contact with (but not joined to) rod 80. Opposite rim 83*a* is a corresponding ledge 86 that is part of main body 23. Between ledge 86 and the underside of rim 83*a* is a resilient spring material that serves to push rim 83*a* (and therefore pad 83) upwards so that pad 83 does not touch the ground. This spring material could be a literal collection of traditional springs, or could include any other suitable known spring-like mechanisms, such as resilient foam that tends to resist deformation. In FIG. 2B, two traditional springs 86*a* and 86*b* are shown for illustrative purposes. A sufficient number of springs (or sufficient covering of spring-like material) would be needed to provide even upward force around the periphery of rim 83*a*. As will be seen below, the springs must also be sufficiently compressible to allow rod 80 to travel in its tracks 88*a* and 88*b*.

Referring now to FIG. 2C, we see a rotated side view of the exterior of platform 69. Now platform 69 has been rotated so that handle 80*b* of rod 80 is viewed head on rather than along its side. It should be appreciated that the appearance of the device of the opposite side is essentially the same.

Handle 80*b* protrudes from main body 73 through track opening 88*b* (just as handle 80*a* protrudes through a like track 88*a* on the opposite side of the platform 69). In FIG. 2C, handle 80*b* is shown resting at end 88*c* of track 88*b*. Within main body 73, as shown in FIG. 2B, springs like 86*a* and 86*b* push upward on pad 83, which in turn pushes upward on rod 80, keeping handle 80*b* at end 88*c* of track 88*b*. Pad 83 is held within main body 73 in this position.

Figure 2D:
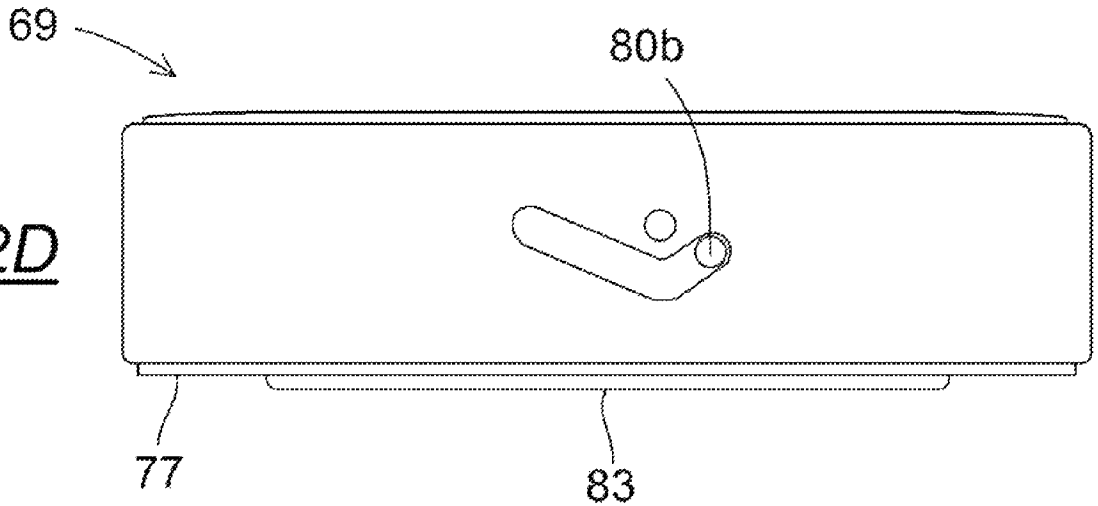
FIG. 2D is a side view of the embodiment shown in FIG. 2A, in the same position as FIG. 2C.

As shown in FIG. 2D, by sliding rod 80 to end 88*d* of track 88*b*, rod 80 is made to push downward on pad 83, causing it to protrude from the bottom of platform 69 so that it engages the ground instead of pad 77. The action of sliding handle 80*b* (and 80*a*) downward to accomplish this requires exerting sufficient force to compress the springs including 86*a* and 86*b*. Those springs are designed to allow compression to an extent that they allow handle 80*b* to pass bend 87, at which point the handle may be released and the spring forces will push handle 80*b* upward into end 88*d*, where it will be restrained in a position that holds pad 83 in an extended position. Grips 81*a* and 81*b* are provided so that a user may squeeze the handles 80*a* and 80*b* toward the grips to aid in compressing the internal springs.

Concentric Pad Embodiment: Gear Mechanism Example

Figure 3A:
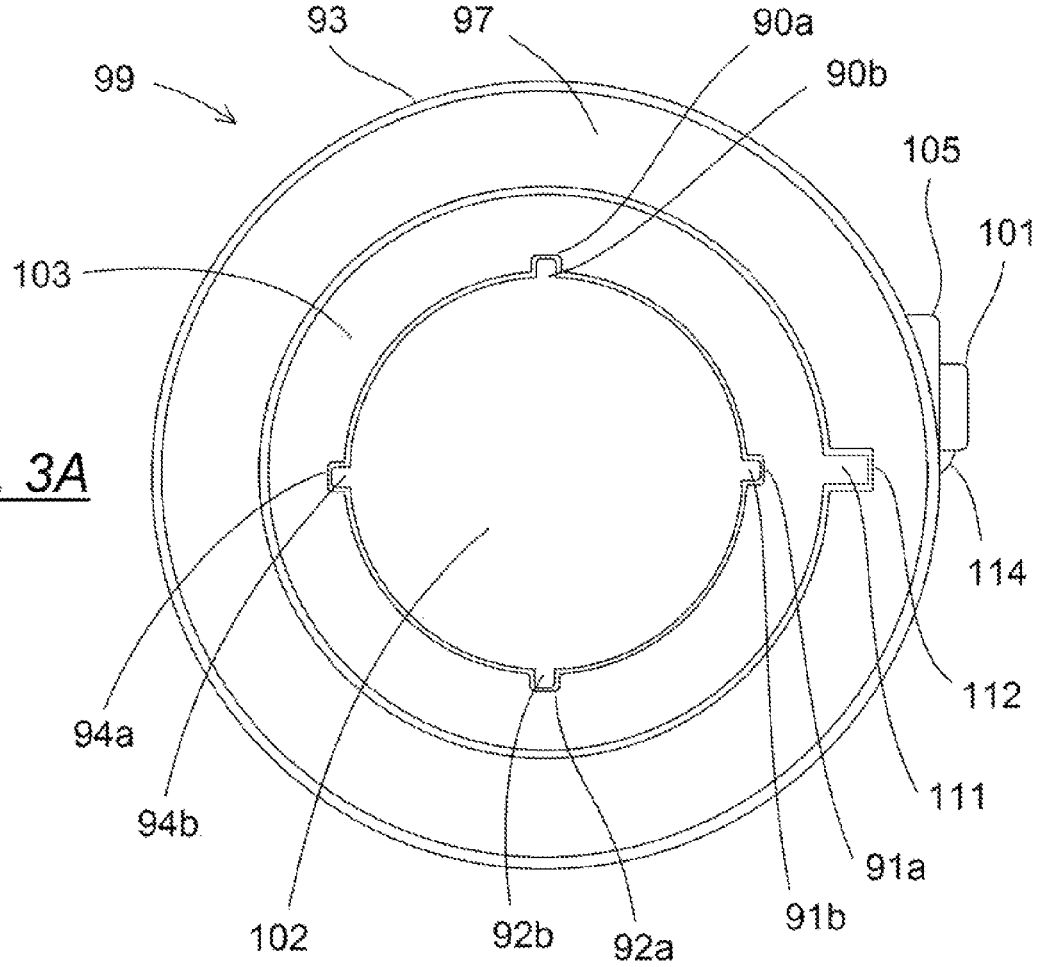
FIG. 3A is a bottom view of another embodiment of the present invention.

Referring now to FIG. 3A, we see a bottom view of another embodiment of the present invention that features concentric pads. Here, portable platform 99 has a main body 93 connected to a central column 102. Central column 102 does not touch the floor, but rather, it serves to support inner pad 103. Inner pad 103 has vertical guide tracks 90*a*, 91*a*, 92*a* and 94*a* that engage vertical ridges 90*b*, 91*b*, 92*b* and 94*b* on central column 102. Thus, inner pad 103 is able to slide vertically up and down relative to central column 102.

Figure 3B:
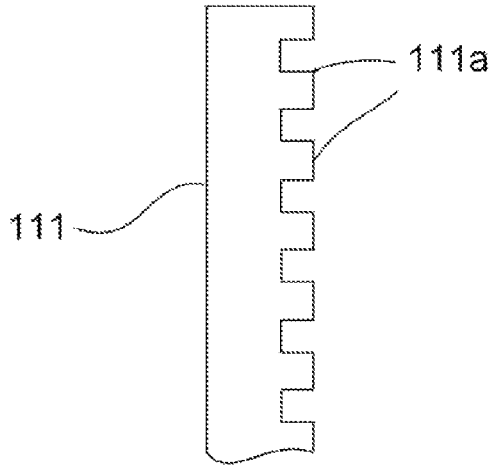
FIG. 3B is a side view of a gear track used with the embodiment shown in FIG. 3A.

On one side of the outer face of inner pad 103 is a vertical gear track 111, a side view of which is shown in FIG. 3B. Gear track 111 has teeth 111*a* for engaging gear 115 attached to knob 101 (as shown later in FIGS. 3C-3E). There is an opening 12 in main body 93 that allows the gear track 111 to move vertically into and out of main body 93 as inner pad 103 is lowered or raised.

Outer pad 97 is directly connected to main body 93 and does not move relative to the rest of the device. When inner pad 103 is retracted, outer pad 97 engages the ground. When inner pad 103 is extended past outer pad 97, pad 103 engages the ground instead of pad 97.

Adjacent to gear track 111 and protruding from one side of main body 93 are knob 101 and projection 105. Knob 101 has a lever handle 114 that is shown inserted into a slot in the side of main body 93 (explained in more detail below). Projection 105 serves to provide a second slot that lever handle 114 may be inserted into.

Figure 3C:
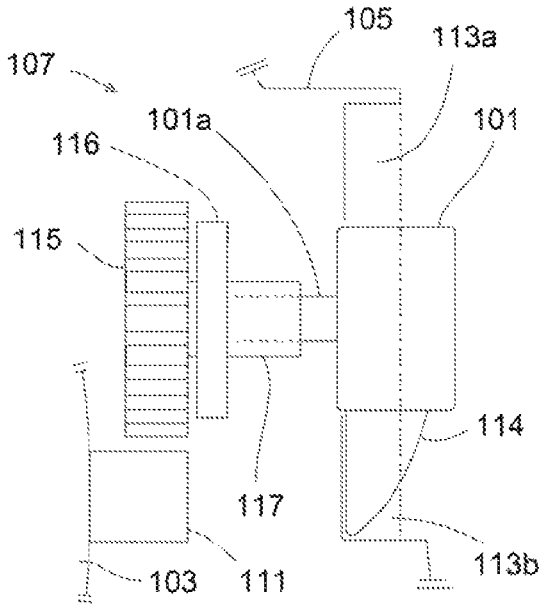
FIG. 3C is a side view of a gear mechanism used with the embodiment shown in FIG. 3A.

Referring now to FIG. 3C, we see an enlarged planar view of gear mechanism 107, featuring knob 101 from FIG. 3A. Here we are looking down the length of vertical gear track 111, whose teeth (not visible) engage corresponding teeth on the perimeter of circular gear 115 (which we see here in side view). The engagement of the teeth is not shown in this drawing for the sake of simplicity. It will be approached that by rotating gear 115, vertical track 111 (and with it, inner pad 103) will be cause to move upward or downward within platform 99. Viewing FIG. 3C, the direction of travel of gear track 111 and inner pad 103 would be into or out of the page.

The axle 117 for gear 115 is held in a bearing mount 116 that is attached to the main body 93 of the device, such that the position of gear 115 remains fixed relative to main body 93. A telescoping shaft 101*a* connects axle 117 to external knob 101, which protrudes from the main body 93 of the device. Shaft 101*a* is coupled with axle 117 in such a manner that, while capable of telescoping, also may cause axle 117 to rotate if shaft 101*a* is rotated. Such a coupling may be achieved with, for example, mating ridges and tracks running along the intersection of shaft 101*a* and axle 117.

Knob 101 has a relatively thin lever handle 114 that is shaped here somewhat like a shark fin (though could have a variety of shapes). In FIG. 3C, handle 114 is shown inserted into a correspondingly thin slot 113*b* in the side of main body 93. If viewed from of the side of platform 99, slot 113*b* would appear as a thin slit just wide enough to accommodate handle 114. It will be appreciated that when handle 114 is inserted into slot 113*b*, it will restrain knob 101 from turning, which will in turn restrain inner pad 103 from moving up or down.

Figure 3D:
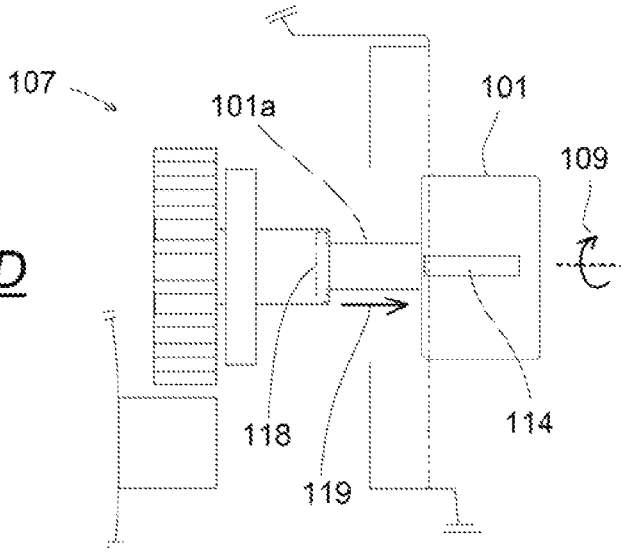
FIG. 3D is a side view of a gear mechanism used with the embodiment shown in FIG. 3A.

Referring now to FIG. 3D, we see that knob 101 may be pulled outward from main body 93 in the direction of arrow 119. Telescoping shaft 101*a* slides outward from axle 117 to allow this to occur. Stopper 118 prevents knob 101 from being pulled out of main body 93 entirely.

FIG. 3D depict knob 101 as it is being twisted in the direction of arrow 109. Lever handle 114 is shown edge-on, and its thinness can be appreciated. Twisting knob 101 in one direction or the other in this manner will cause inner pad 103 to either move upwards or downwards relative to the floor.

By twisting knob 101 the rest of the way shown by arrow 109, and then pushing knob 101 back into the main body 93, lever handle 114 may be inserted into slot 113*a*, which will restrain the knob 101 from further rotation and "lock" the inner pad in a new position. This final arrangement is depicted in FIG. 3E.

Figure 3E:
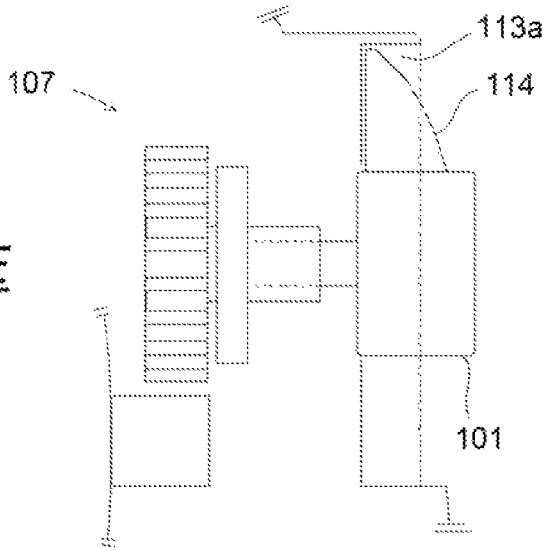
FIG. 3E is a side view of a gear mechanism used with the embodiment shown in FIG. 3A.

It is of course possible that a duplicate version of gear assembly 107 shown in FIGS. 3C-3E might be added to the opposite side of main body 93, along with a corresponding second version of vertical gear track 111 on inner pad 103. Having two gear systems (and therefore two knobs) will allow the user of the platform to exert greater force raising or lowering inner pad 103.

It will be appreciated that although the foregoing three embodiments all employed a moveable inner pad, it would not take significant re-engineering to permit the outer pad to move in the same manner. Likewise, other advantageous adaptations of the device, such as using different dimensions, or having longer (or differently shaped) knobs, handles and levers, etc. may be adopted to suit particular applications.

Multiple Pad Embodiment

Although the foregoing embodiments featured two concentric circular pads for contacting the floor, multiple pads may also be used. Multiple pads may each employ variants of the screw, spring and gear mechanisms disclosed above, or their equivalents. Alternatively, as described below, the pads may each individually be extended outward by a pushing structure that directly presses them toward the ground.

Figure 4C:
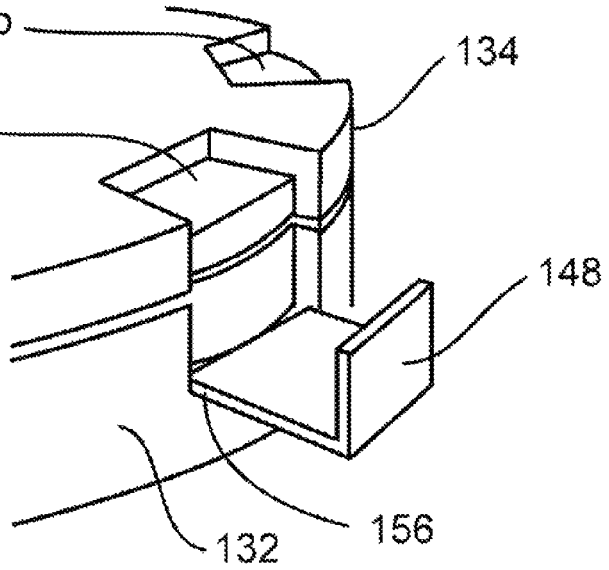
FIG. 4C is a perspective view of a portion of the top and side of the embodiment shown in FIG. 4A.

Referring to FIGS. 4A-4E, we see one possible embodiment of a multi-pad version of the invention. FIG. 4A shows portable platform 130 having a circular top portion 134 that is capable of rotating relative to main body portion 132. Depending on the requirements of the device, this rotation may be accomplished by placing a bearing mount between top portion 134 and main body 132, or any other known surface for allowing rotation of one part relative to another. In a minimalist embodiment, it can be sufficient that top portion 134 is physically separate from main body 132, and the force exerted by the user will be enough to rotate one relative to the other. A central column 152 may run through main body 132 and connect with top portion 134.

Main body 132 has a locking latch 148 capable of engaging either of two latch grooves 150*a* or 150*b* in top portion 134. The function of the locking latch and grooves will be explained further below.

Main body 132 may be provided with holes, such as hole 136, or handles or hooks for the attachment of accessories such as pull cables, rods or elastic chords. As with all other embodiments disclosed herein, handles may be added to any part of the platform to assist the user with gripping and moving the device.

Protruding from main body 132 are a series of rocker pads 138, 140, 142, 144 and 146. As shown here, ends 138*a*, 140*a*, 142*a*, 144*a* and 146*a* of the rocker pads extend the furthest away from the base of main body 132, and these ends will engage the ground and support the platform. As will be discussed later, these ends may have a Teflon coating, or similar low-friction coating, to allow the platform 130 to slide across the ground. Although five rocker pads are shown here, it will be apparent from the present disclosure that any number may be used so long as they are capable in combination of supporting the weight of platform 130 and whatever objects it is intended to carry.

Referring to FIG. 4B, top portion 134 has now been rotated in the direction of arrow 154. Locking latch 148, which previously engaged latch groove 150*b* in FIG. 4A, is now locked into latch groove 150*a*. The rotation of the top portion 134 relative to the main body 132 has caused an internal mechanism (shown in later figures) to retract rocker ends 138*a*, 140*a*, 142*a*, 144*a* and 146*a* and instead cause rocker ends 138*b*, 140*b*, 142*b*, 144*b* and 146*b* to extend from main body 132 and engage the ground. Rocker ends 138*b*, 140*b*, 142*b*, 144*b* and 146*b* are depicted as having a flat edge that will cover a greater surface area, resulting in greater friction with the ground as compared to a curved end that engages less surface area. By coating rocker ends 138*b*, 140*b*, 142*b*, 144*b* and 146*b* in a rubberized material, friction with the ground will be further increased.

Referring now to FIG. 4C, we see a close-up of the locking latch mechanism whose purpose is to restrain top portion 134 from rotating relative to main body 132. Locking latch 148 is mounted to main body 132 by a hinge 156, and the user can disengage the locking latch 148 from top portion 134 by rotating the latch about its hinge. This will unlock top portion 134 from main body 132 and allow the top portion 134 to rotate relative to main body 132.

Pressing locking latch 148 upward so that it engages either groove 150*a* or 150*b* will lock top portion 134 relative to main body 132. A snap fitting or other commonly known mechanism may be employed to hold locking latch 148 in groove 150*a* or 150*b* when the user presses the latch into either of those grooves.

It will be appreciated that more than one locking latch mechanism like that shown in FIG. 4C may be employed around the perimeter of the device. Also, alternative latching mechanisms may be used suitable for restraining rotation of the top portion relative to the main body.

Figure 4D:
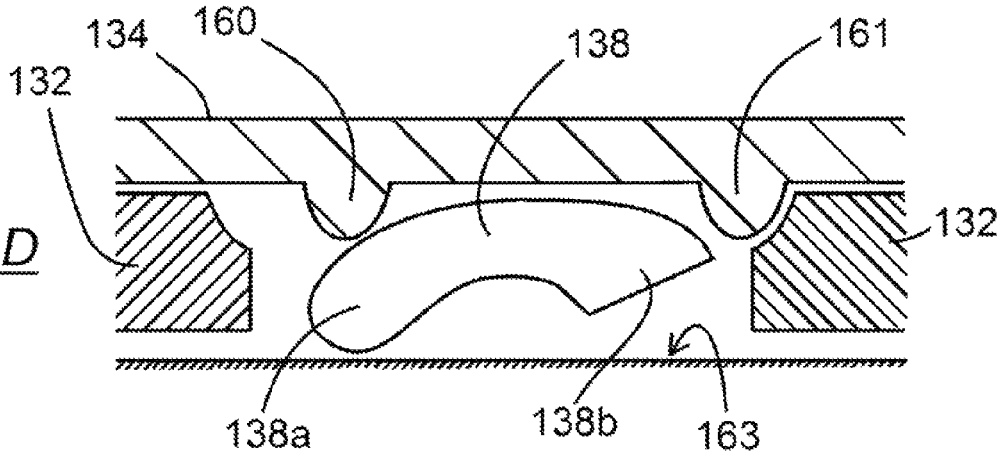
FIG. 4D is a side cross-sectional view of a portion of the embodiment shown in FIG. 4A.
Figure 4E:
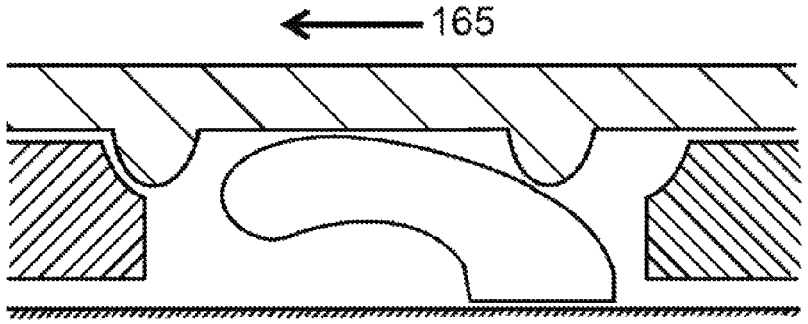
FIG. 4E is a side cross-sectional view of a portion of the embodiment shown in FIG. 4A.

FIGS. 4D and 4E show a cross-sectional side view of a portion of platform 130 surrounding rocker pad 138. A similar cross-section would be seen at the other rocker pads. In FIG. 4D, we see that the underside of top portion 134 is provided with two raised portions 160 and 161. Here, top portion 134 has been rotated relative to main body 132 such that raised portion 160 presses downward on end 138*a* of rocker pad 138, causing end 138*a* to engage the ground 163, and end 138*b* to remain retracted within main body 132.

By twisting top portion 134 in the direction of arrow 165, end 138*a* is released and now raised portion 161 will press downward on opposite end 138*b* of rocker pad 138. This will cause end 138*b* to engage the ground instead of end 138*a*, which remains retracted within the main body 132.

Figure 5C:
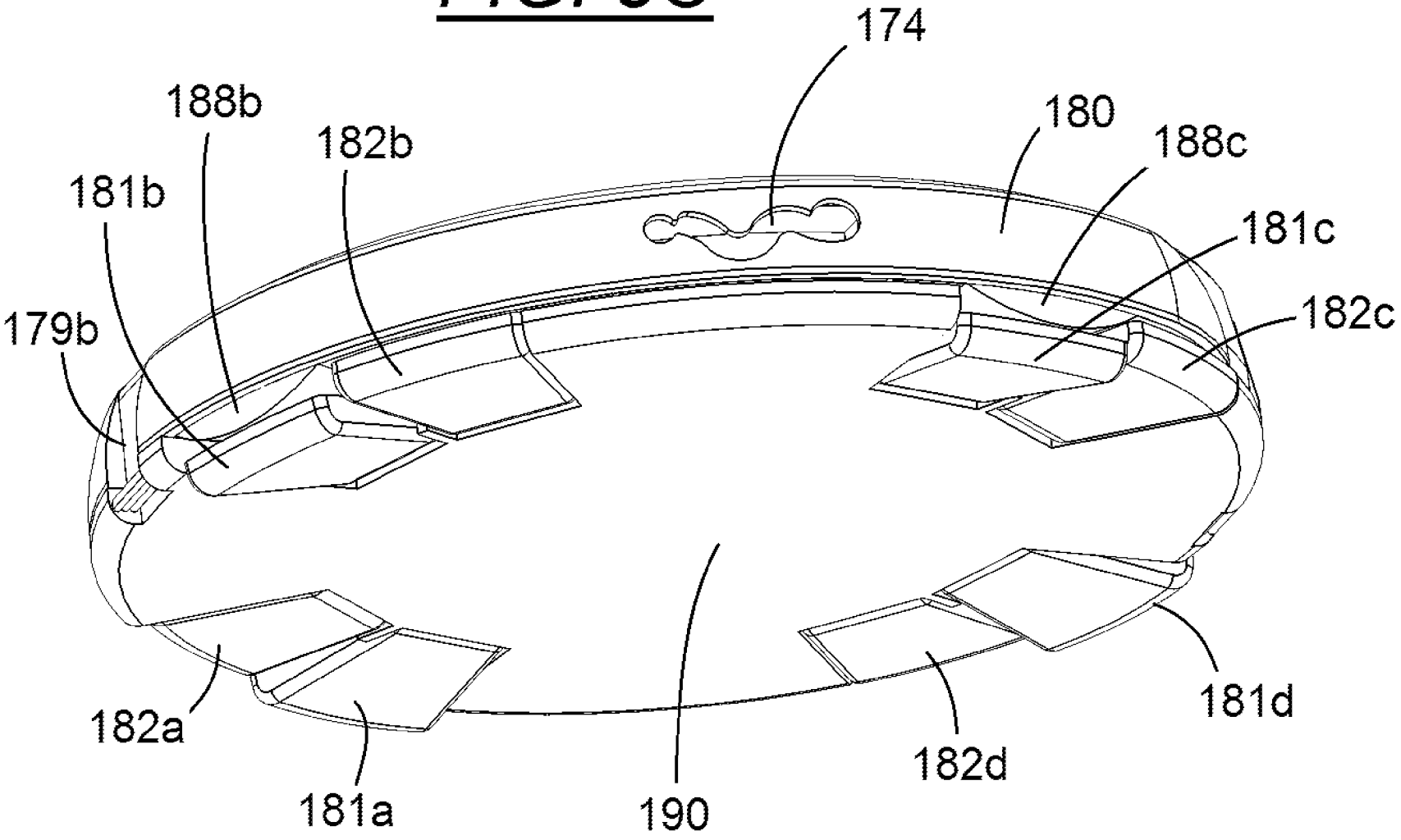
FIG. 5C is a perspective view of the underside and side of the embodiment shown in FIG. 5A.

Referring now to FIGS. 5A-5C, we see an alternative embodiment 170 of a multiple pad version of the present invention. FIG. 5A shows a top view of the device, with a foam pad 172 covering its surface.

Holes and slots 176 and 174 in the side of top portion 180 allow for the attachment of cables or chords that may be used to pull the platform, or for use in fitness routines if the platform is used as an exercise device.

FIGS. 5B and 5C show a side and perspective underside view of device 170, respectively. Top portion 180 of the main body is rotatable relative to the lower portion 190 of the main body. Connected to top portion 180 are pushing structures 188*a*, 188*b*, 188*c* and 188*d* (not shown). As shown in FIGS. 5B and 5C, the pushing structures are simultaneously causing all of feet 181*a*, 181*b*, 181*c* and 181*d* to be extended from underside of the device at the same time. If the top portion of the platform 180 is rotated relative to the bottom portion 190, the pushing structures will shift position and cause all of feet 182*a*, 182*b*, 182*c* and 182*d* to extend.

By equipping all of feet 181*a-d* with a low-friction material, and all of feet 182*a-d* with a high friction material, it will be understood that the device can be made to alternate between a sliding and a stationary mode.

Each of the feet may be equipped with resilient hinge connected to the lower portion of main body 190 that tends to elastically keep those feet retracted unless they are pushed downward by the pushing structures. Alternatively, a thin cable connecting the side of each foot to a hole in the lower portion 190 will also serve to tend to keep the feet retracted unless actively pushed downward.

It should be noted that even if the unengaged feet are not actively retracted relative to the engaged feet, they will simply "coast" along the ground because no force is acting to push them against the ground. In this regard, the engaged feet that have a force applied to them are still deemed to be "extended" relative to the unengaged feet by virtue of the fact that they are being actively held outward, even though they may visually appear to be parallel with the feet that are coasting. By the same token, the unengaged feet may be deemed for purposes of the present disclosure to be "retracted" relative to the engaged feet. It is the force applied to a given foot that will cause it to actively engage the ground with whatever type of friction surface that foot may have. Thus, while it is preferred that the engaged feet literally extend past the unengaged feet, such a configuration is not strictly necessary, and the unengaged feet may be allowed to coast.

A locking mechanism is provided to secure the device in either a stationary or sliding mode. Two latch slots 179*a* and 179*b* are provided in the side of the device. A latch 177 in hinged on either the top portion 180 or the bottom portion 190. By releasing the latch, top portion 180 may be rotated relative to bottom portion 190 to accomplish switching from one mode to another. When latch 177 is opened, it conveniently serves as a handle to help rotation during mode switching. One the top and bottom portions are rotated into position, the latch 177 can be re-latched, locking the device in a new mode.

Number of Movements

It is an object of the present invention to provide a portable platform that is capable of easily switching from stationary to sliding modes without the user having to lift the device off the ground or perform an undue number of steps. Indeed, in a preferred embodiment, the user will be able to switch between sliding and stationary modes "on the fly" while the platform is resting on the ground.

With regard to the objective of allowing the platform to remain on the ground, one might imagine an alternative design for a portable platform in which the top surface had a low-friction property and the bottom surface had a high-friction property, and the user could easily switch from one mode to the other by simply flipping the device over. While that might be convenient for some users, it would have a number of significant disadvantages.

First, the platform could not switch modes while an object is still being supported by its top surface: the object would have to be removed. This might prove inconvenient if the object is heavy and still needs to be transported by the platform to another location. In the case of the platform being used by someone as an exercise device, it may inconvenience the user to have to stop their fitness routine to flip the device. Moreover, the top surface may be designed to have a foam pad or handles for the user to grip the platform, and it would be impractical to also have low and high-friction surfaces overlapping with the padding or handles. In addition, the user will undoubtedly want to minimize touching a portion of the platform that has just been dragged repeatedly across the floor.

As discussed above, it has also been proposed by others to have a portable exercise platform with a detachable base, allowing the user to switch from sliding to stationary modes by lifting the device off the ground and locking or unlocking the base into position. Once again, this system has the disadvantage of requiring the user to remove the load from the top of the platform, lift it up, and swap out the base. The system has the further disadvantage of requiring the device to be split into two parts rather than be self-contained.

It should be understood that while the present invention can operate without being lifted off the ground, it is not intended to foreclose the user from lifting the device off the ground to some extent if they so choose or if it helps them gain a better grip on the device. Thus references herein to the device being capable of switching between sliding and stationary modes refer to not necessarily having to lift the device off the ground, or lifting it off the ground only slightly or fleetingly. This stands in contrast to devices that are completely incapable of switching modes unless they are lifted entirely off the ground to either flip the device over, or swap out the base.

With regard to the number of movements that are required of the user to switch the device from sliding to stationary mode or back again, the present invention includes several embodiments that allow the mode switch to occur with only one, two or three primary movements.

As used herein, the term "primary movements" refers to actions that may be performed more or less in one fluid motion without having to stop in the middle. Examples of primary movements include:

(A) twisting a portion of the device relative to the rest of the device substantially in one movement;

(B) turning or moving a handle from one position to another, including motions that require the handle to travel an uneven path but may performed substantially without stopping; and (C) opening a latch or closing a latch.

With reference to the disclosed embodiments of the invention herein, the device shown in FIGS. 1A-1E may switch from sliding to stationary modes in two primary movements: (1) lifting the spring-loaded latch 51 or 41, and (2) sliding the handle 30 from one end of track 31 to the other until it locks in place behind the other latch. The modified version shown in FIG. 1F allows the mode switch to occur in only one primary movement by virtue of eliminating the latches and causing the handle to follow an uneven path that serves to lock it in one position or the other.

The device shown in FIGS. 2A-2D also allows the mode switch to occur in a single primary movement. By squeezing handle 80*b* towards handle 81*b*, handle 80*b* is made to move from one end of track 88*b* to the other, causing the inner pad 83 to retract or lower. The user may need to use two hands, with the other gripping the corresponding handles 80*a* and 81*a* on the opposite side of the device, but the action of the mode switch may nonetheless be achieved in one primary movement. The user's motion may slow down somewhat getting the handle around track bend 87, but need not be stopped in a manner that would require a second primary movement of the handle.

We see in the preceding example that in the course of switching the modes of the platform, the user might inadvertently or slightly lift the platform off the ground by virtue of exerting force upon the handles, but the extent of such lifting would be fairly minor and still fall within the category of not requiring the device to be lifted off the ground, as that concept is used herein to distinguish devices that are required to be lifted entirely off the ground.

With reference to the device shown in FIGS. 3A-3E, only one primary movement is needed to twist the knob 101 to switch the modes of the device. The knob 101 will need to be pulled outward as shown by arrow 119 and then pushed back in, but the actions of pulling out, twisting and pushing back in can be performed in one substantially fluid motion without stopping.

The device shown in FIGS. 4A-4E requires three primary movements to switch modes: (1) unlatching latch 148, (2) twisting top portion 134 relative to main body 132, and then (3) relatching latch 148.

The device shown in FIGS. 5A-5C requires three primary movements to switch modes: (1) unlatching latch 177, (2) twisting top portion relative 180 relative to bottom portion 190, and (3) relatching latch 177.

It should be noted here that, which regard to primary movements that involve moving a handle or latching a latch, this disclosure has refer to a variety of "locking mechanisms" whose purpose is to secure the pads under the platform in either an extended or retracted condition. Certain of these locking mechanisms may be more secure than others, but all fall with the definition of the term "locking mechanism" so long as they are generally capable of preventing the platform from switching from a sliding mode to a stationary mode (or vice versa) without deliberate action by the user.

Ground Surfaces and Materials

It is foreseen that the present invention will be used on ground surfaces that include at least (1) common indoor flooring such as hardwood, carpeting, tile, ceramic, marble, linoleum (or other plastic flooring), and smooth concrete, and (2) certain generally smooth outdoor surfaces such as asphalt and pavement (though other, more uneven, outdoor surfaces may be traversed when pads of the invention are equipped with ball transfer units). When used as exercise equipment, it is foreseen that the present invention will most often be used on hardwood flooring, carpets, or firm plastic flooring. When used to move heavy objects, the invention might be used with outdoor surfaces as well as indoor surfaces.

As discussed above, the ability of the present invention to switch from a sliding to a stationary mode is accomplished by supplying at least two separate pads (or sets of pads) having alternating engagement with the ground wherein one of the pads (or sets of pads) has a high-friction coating and the other of the pads (or sets of pads) has a low-friction coating. For most applications, it will be sufficient for the high-friction coating to consist of a rubber material, which, as used herein, encompasses not only actual rubber, but any rubber-like materials such as synthetic rubber, firm silicone, and the like. The high-friction material can be provided with grooves or ridges to increase its friction.

There are two fundamentally different kinds of low-friction surfaces that may be employed: (1) those that are flat and smooth, and (2) those that include exposed rolling elements such as ball transfer units (i.e., a bearing ball mounted so that only a portion is exposed to engage the ground). With regard to ball transfer units, they may be manufactured in a wide variety of sizes and various quantity may be incorporated into a given pad. For example, if the device is to be used principally on a smooth, flat, rigid surface like hardwood flooring, relatively small ball transfer units (e.g., bearing balls less than 1 inch diameter) may be used and spaced relatively closely to one another on the bottom of the pad (e.g., 1 inch spacing). Where the ground is more uneven and requires that the device be elevated further (e.g., carpeting), larger bearing balls may be used to achieve the requisite elevation, and they may be spaced proportionately further apart from one another on the pad. In the case of embodiments with a larger number of pads with relatively smaller contact points with the ground (e.g., FIGS. 4A-5C), those contact points may include a single ball transfer unit. Although there is no reason that traditional caster wheels could not be employed on the low-friction pad surfaces, these are less preferable to ball transfer units because ball transfer units tend to have a lower profile, fewer parts, more stability, and more easily allow omnidirectional rolling.

The second alternative for a low-friction pad surface is a flat, smooth coating. This kind of coating is ideal for hardwood flooring, carpeting, and smooth indoor surfaces. Perhaps the best low-friction coating material of this kind is Teflon, which can be applied as a smooth, flat coating on the bottom surface of the low-friction pads. Teflon coatings of this kind have been used modernly in conjunction with small discs placed under heavy furniture legs to allow furniture to slide across indoor surfaces (although the applicant is unaware of any previous use of Teflon with a device of the kind claimed herein). Other smooth plastic/polymers materials that are capable of being applied in a relatively hard, smooth coating are also capable of providing a low-friction interface with the ground, and may be selected to suit the degree of friction required by the user.

Generally speaking, it will be desirable that the high-friction coating have a coefficient of static friction with the ground greater that about 0.6, and that the low-friction coating have a coefficient of static friction with the ground of less than about 0.1. (Note that the coefficient of kinentic friction for most materials is lower than the coefficient of static friction, but it suffices here to use the coefficient of static friction as a guidepost, particularly since it is relevant to both the high-friction and low-friction materials). Of course, if the user desires that the "low-friction" pads actually retain some degree of friction to control the speed of the device in its sliding mode, materials with higher coefficients of friction may be chosen for the low-friction pads. Tables showing the coefficients of friction of common materials are ubiquitous and made be easily found online or in technical journals.

As used herein, "high-friction" is intended to refer to a material (such as a rubberized material) that will tend to have a coefficient of static friction greater than about 0.6 with most ground surfaces. Unless otherwise specified, "low friction" will refer generally to materials having a coefficient of static friction with the ground of less than 0.6, selected by the user to allow the device to have the desired degree of slippage with the ground for a particular purpose. "Low-friction" includes rotary attachments like embedded ball transfer units. When the user desires to use the device as fitness equipment, it is advisable to select either ball transfer units, a smooth Teflon coating, or similar low-friction polymer coating as the "low-friction" material, where coating materials have coefficients of static friction of about 0.1 or lower. When the user desires to use the device to move heavy equipment that should not be allowed to freely slide across the floor unless deliberately pushed, the low-friction surface should consist of a coating of a material having a higher coefficient of friction. For example, wood and certain hard polymers have coefficients of static friction with common ground surfaces that range from about 0.2-0.5.

Elastic Cover Embodiment

The embodiments of the invention disclosed above all involved discrete pads that contact the ground. The invention can also be made to work by covering the underside of any of the embodiments with a smooth, durable elastic covering—like a membrane over the barrel of a drum. This membrane should be made of a suitably durable rubberized material and elastically stretched across the underside of the device such that it defaults to having a smooth, flat surface. The elasticity of the membrane should be such that when one of the pads is extended from the main body of the platform, the membrane will flex outward toward the ground where it is pressed internally by the pad.

By supplying the outer surface of the membrane at these pad contact points with a material of a different friction than the rest of the membrane, the platform can be made to switch from a sliding to a stationary mode. For example, if the portion of the membrane underneath the first set of pads has a high-friction outer coating, and the portion of the membrane underneath the second set of pads has a low-friction coating, extending the second set of pads will cause the platform to switch to a sliding mode. In this example, the second set of pads must be able to retract into the main body of the platform such that when retracted, the weight of the platform is borne by the portion of the membrane under the first set of pads, causing the device to switch to a high-friction mode.

Supplying an elastic membrane of the type just described will improve the platform's ability to slide across common indoor ground surfaces such as hardwood floors, carpet and tile.

Figure 6:
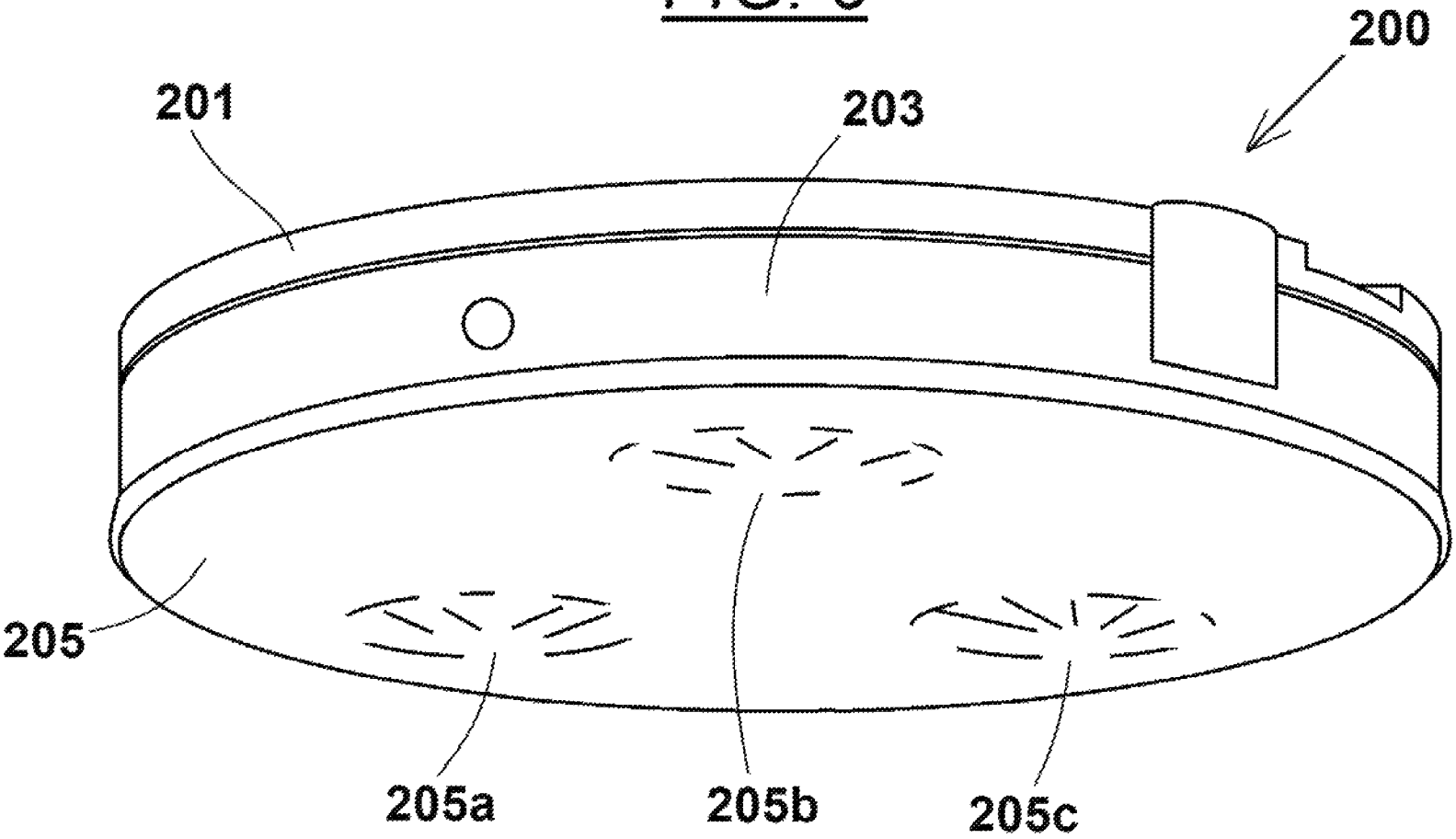
FIG. 6 is a perspective view of the underside of another embodiment of the present invention.

FIG. 6 depicts an embodiment 200 of the invention having a top portion 201 that can rotate relative to bottom portion 203 in the same manner as the embodiment 130 in FIGS. 4A and 4B. An elastic cover 205 as just described is stretched across the base of the device like the membrane of a drum. Underneath the elastic cover 205 are pads similar to those depicted in FIGS. 4A and 5C. In the present embodiment, three pads are extended, causing protruding deformations 205*a*, 205*b* and 205*c* in the elastic covering 205. If the external surface of the cover 205 at these locations has a low friction surface, the device 200 will be able to slide across the ground. If those same portions of the cover have a high friction surface, the device 200 will tend to remain stationary under a weight load.

Generic Description of a Particular Multiple Pad Embodiment

One way of describing a particular multiple-pad embodiment of the present invention is as follows:

A portable platform capable of alternating between a sliding mode and a stationary mode, said platform comprising: (a) a main body having a top side for supporting one or more objects to be slid substantially parallel to the ground, and a bottom side exposed to the ground; (b) two or more rocker pads extending from the underside of said main body, each of said rocker pads having a pivot point secured to said main body and a first end on one side of a pivot point and a second end on the other side of said pivot point, said rocker pads shaped such that when one of said ends engages the ground the other of said ends is retracted away from the ground; (c) each of said rocker pads provided with a user-manipulatable pushing structure for pushing down on one of said ends of said rocker pad to cause said one of said ends to extend from said main body and engage the ground; and (d) a locking mechanism for causing said pushing structure to be held in a fixed position when said pushing structure holds said one of said ends in engagement with the ground.

The embodiment just described may further include the following features: (a) wherein said platform has a top portion rotatably mounted on top of said main body, and wherein each of said rocker pads is provided with a first and second of said pushing structures, one for pushing down on said first end and the other for pushing down on said second end, and wherein all of said pushing structures are attached to said top portion, and wherein rotating said top portion relative to said main body in one direction will cause all of said first pushing structures to push down on all of said first ends of said rocker pads, and wherein rotating said top portion relative to said main body in the other direction will cause all of said second pushing structures to push down on all of said second ends of said rocker pads; or (b) wherein all of said first ends of said rocking pads are capable of being in engagement with the ground simultaneously and wherein all of said first ends of said rocker pads have a low-friction surface; and wherein all of said second ends of said rocking pads are capable of being in engagement with the ground simultaneously and wherein all of said second ends of said rocker pads have a high-friction surface; or (c) wherein the underside of said platform is covered by an elastic membrane capable of being stretched outward by the extension of said ends of said rocker pads; and wherein the outer portion of said membrane beneath at least one of said ends is supplied with a first friction material, and the outer portion of said membrane beneath at least one other of said ends is supplied with a second friction material; and wherein one of said first and second friction materials is a high-friction material, and the other is a low-friction material.

Although the invention has been described throughout this specification in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A portable platform capable of alternating between a sliding mode and a stationary mode, said platform comprising:

(a) a main body having a top side for supporting one or more objects to be slid substantially parallel to a ground, and a bottom side configured to be exposed to the ground;

(b) a set of first pads comprising one or more first pads extending from said bottom side and capable of engaging the ground; said set of first pads capable of supporting a weight of said platform and said one or more objects;

(c) a set of second pads comprising one or more second pads capable of being extended from said bottom side of said main body and past said set of first pads;

(d) wherein said set of second pads is capable of being held in a position past said set of first pads and engaging the ground instead of said set of first pads;

(e) wherein said set of second pads is capable of supporting the weight of said platform and said one or more objects;

(f) wherein said set of second pads is also capable of being retracted toward said main body of said platform and held in a retracted position such that said set of first pads engage the ground instead of set of said second pads; and (g) wherein one of said sets of pads has a low-friction surface for engaging the ground, and wherein the other of said sets of pads has a high-friction surface for engaging the ground.

2. The platform of claim 1, wherein said platform is capable of switching between said sliding mode and said stationary mode, and locking in one mode or the other, with one primary movement while substantially remaining in contact with the ground.

3. The platform of claim 1, wherein said platform is capable of switching between said sliding mode and said stationary mode, and locking in one mode or the other, with two primary movements while substantially remaining in contact with the ground.

4. The platform of claim 1, wherein said platform is capable of switching between said sliding mode and said stationary mode, and locking in one mode or the other, with three primary movements while substantially remaining in contact with the ground.

5. The platform of claim 1, wherein all of said second pads can be extended simultaneously and retracted simultaneously.

6. The platform of claim 1, wherein said set of second pads has only one of said second pads, and wherein said one second pad is centered in said platform such that it is capable of supporting said platform without said set of first pads engaging the ground when said one second pad is extended, and wherein said one second pad has a screw thread that is rotatably mounted to a corresponding screw thread in said main body of said platform; and wherein rotating said second pad relative to said main body allows retraction and extension of said one second pad.

7. The platform of claim 6 wherein said one second pad has an arm that extends from said one second pad out of a side of said main body; and wherein said arm may be moved to cause said one second pad to rotate relative to said main body.

8. The platform of claim 1, wherein said set of second pads has only one second pad, and wherein said one second pad is centered in said platform such that it is capable of supporting said platform without said set of first pads engaging the ground when said one second pad is extended, and wherein said one second pad is braced against a portion of said main body by a spring element that exerts a force on said one second pad upward from the ground and with sufficient force to prevent said one second pad from moving relative to said main body under the force of gravity; and further comprising a handle for pushing downward on said one second pad against the force of said spring element, and further comprising a locking mechanism for holding said one second pad in a position past said set of first pads and in engagement with the ground.

9. The platform of claim 8, wherein said locking mechanism includes a track for said handle in a side of said main body, wherein said track has a projection that will restrain said handle when said handle is pushed past said projection.

10. The platform of claim 1, wherein said set of second pads has only one second pad;

wherein said one second pad is centered in said platform such that it is capable of supporting said platform without said set of first pads engaging the ground when said one second pad is extended;

wherein said one second pad has a gear track mounted along a side of said one second pad;

wherein a gear is provided mounted to said main body of said platform for engaging said gear track to cause said one second pad to move vertically relatively to the ground; and further comprising a user-manipulatable knob connected to said gear and accessible from an exterior of said main body.

11. The platform of claim 10, wherein said knob includes a lever projecting from its side, and wherein said main body is provided with a structure for restraining said lever in a fixed position to restrain said knob.

12. The platform of claim 1, wherein the bottom side of said platform is covered by an elastic membrane capable of being stretched outward by extension of said set of second pads;

wherein said high and low-friction surfaces are supplied by high and low-friction materials on portions of an outer surface of said membrane that are beneath said first and second sets of pads;

wherein the portions of said outer surface of said membrane beneath said first set of pads are supplied with a first friction material, and the outer portions of said membrane beneath said second set of pads are supplied with a second friction material; and wherein one of said first and second friction materials is a high-friction material, and the other is a low-friction material.

13. A portable platform capable of alternating between a sliding mode and a stationary mode, said platform comprising:

(a) a main body having a top side for supporting one or more objects to be slid substantially parallel to a ground, and a bottom side configured to be exposed to the ground;

(b) a set of first feet comprising one or more first feet extending from said bottom side and capable of engaging the ground; said set of first feet capable of supporting a weight of said platform and said one or more objects;

(c) a set of second feet comprising one or more second feet capable of being extended from said bottom side of said main body, said set of second feet capable of supporting the weight of said platform and said one or more objects;

(d) wherein one of said sets of feet has low-friction surfaces for engaging the ground, and wherein the other of said sets of feet has high-friction surfaces for engaging the ground.

14. The platform of claim 13, further comprising:

(a) a first set of user-manipulatable pushing structures, one for each of said first feet, each of said first set of pushing structures capable of pushing down on a corresponding one of said first feet to cause said one of said first feet to extend away from said bottom side of said platform; and (b) a second set of user-manipulatable pushing structures, one for each of said second feet, each of said second set of pushing structures capable of pushing down on a corresponding one of said second feet to cause said one of said second feet to extend away from said bottom side of said platform.

15. The device of claim 14, wherein said platform has a top portion rotatably mounted on top of said main body, and wherein all of said pushing structures are attached to said top portion;

wherein rotating said top portion relative to said main body in one direction will cause all of said first pushing structures to push down on all of said first feet; and wherein rotating said top portion relative to said main body in an opposite direction will cause all of said second pushing structures to push down on all of said second feet.

16. The device of claim 13, in which each of said first feet is paired with one of said second feet, and wherein each of said pairs shares a single pushing structure;

wherein rotating said top portion relative to said main body in one direction will cause all of said single pushing structures to push down on all of said first feet; and wherein rotating said top portion relative to said main body in an opposite direction will cause all of said single pushing structures to push down on all of said second feet.

17. The device of claim 13, wherein the bottom side of said platform is covered by an elastic membrane capable of being stretched outward by extension of said feet;

wherein said high and low-friction surfaces are supplied by high and low-friction materials on portions of an outer surface of said membrane that are beneath said feet;

wherein the portion of said outer surface of said membrane beneath at least one of said feet is supplied with a first friction material, and the portion of said outer surface of said membrane beneath at least one other of said feet is supplied with a second friction material; and wherein one of said first and second friction materials is a high-friction material, and the other is a low-friction material.

18. A method by which a person can perform a fitness routine comprising:

(a) providing a portable platform capable of alternating between a sliding mode and a stationary mode, said platform comprising:

(A) a main body having a top side for supporting one or more objects to be slid substantially parallel to a ground, and a bottom side configured to be exposed to the ground;

(B) a set of first pads comprising one or more first pads extending from said bottom side and capable of engaging the ground; said set of first pads capable of supporting a weight of said platform and said one or more objects;

(C) a set of second pads comprising one or more second pads extending from said bottom side and capable of engaging the ground; said set of second pads capable of supporting the weight of said platform and said one or more objects;

(D) wherein one of said sets of pads has a low-friction surface for engaging the ground, and wherein the other of said sets of pads has a high-friction surface for engaging the ground;

(b) said person causing said one of said sets of pads that has a low-friction surface to engage the ground;

(c) said person placing part of their body on said top side of said platform and said person applying a force to slide said platform relative to the ground while said platform bears at least part of said person's weight;

(d) said person causing said one of said sets of pads that has a high-friction surface to engage the ground; and (e) said person placing part of their body on said top side of said platform and said person performing a fitness exercise that includes bearing at least part of their weight on said platform.

19. The method of claim 18, further comprising providing said set of second pads with the ability to extend from said bottom side of said main body and past said set of first pads; said set of second pads being capable of being held in a position past said set of first pads and engaging the ground instead of said set of first pads; said set of second pads also capable of being retracted toward said main body of said platform and held in a retracted position such that said set of first pads engage the ground instead of said set of second pads.

20. The method of claim 18, further comprising providing the bottom side of said platform with an elastic membrane capable of being stretched outward by extension of said sets of pads;

wherein said high and low-friction surfaces are supplied by high and low-friction materials on portions of an outer surface of said membrane that are beneath said sets of pads;

wherein the portion of said outer surface of said membrane beneath said set of first pads is supplied with a first friction material, and the portion of said outer surface of said portion of said membrane beneath said set of second pads is supplied with a second friction material; and wherein one of said first and second friction materials is a high-friction material, and the other is a low-friction material.

* * * * *